US006367902B1

(12) United States Patent
Saund et al.

(10) Patent No.: US 6,367,902 B1
(45) Date of Patent: Apr. 9, 2002

(54) EFFECTOR PLATFORM FOR PERFORMING ACTIONS OVER VERTICAL SURFACES

(75) Inventors: Eric Saund, San Carlos; Mark H. Yim, Palo Alto; Kenneth P. Fishkin, Redwood City; Daniel L. Larner, San Jose; Thomas P. Moran, Palo Alto, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/450,484

(22) Filed: Nov. 29, 1999

(51) Int. Cl.[7] ..... B41J 29/393; B41J 3/00
(52) U.S. Cl. ..... 346/139 R; 347/2
(58) Field of Search ..... 347/19, 2; 33/1 M; 346/139 R

(56) References Cited

U.S. PATENT DOCUMENTS

| | | | | |
|---|---|---|---|---|
| 3,665,608 A | | 5/1972 | Stockebrand | 33/1 M |
| 4,135,245 A | | 1/1979 | Kemplin et al. | 364/520 |
| 4,288,798 A | | 9/1981 | Hollmayer | 346/139 R |
| 4,401,996 A | | 8/1983 | Shirahata | 346/139 R |
| 4,412,383 A | | 11/1983 | Landa | 33/1 M |
| 4,496,958 A | | 1/1985 | Brandt et al. | 346/139 R |
| 4,501,931 A | | 2/1985 | Ohya et al. | 178/18 |
| 4,564,078 A | | 1/1986 | Enokido et al. | 178/18 |
| 4,583,292 A | | 4/1986 | Langberg | 33/1 M |
| 4,600,083 A | | 7/1986 | Parent et al. | 187/7 |
| 4,628,326 A | | 12/1986 | Fukumura et al. | 346/29 |
| 4,754,288 A | | 6/1988 | Lawrence | 346/29 |
| 4,833,490 A | | 5/1989 | Zur | 346/139 R |
| 4,843,406 A | | 6/1989 | Murray et al. | 346/1.1 |
| 4,849,771 A | | 7/1989 | Lawrence et al. | 346/139 R |
| 4,856,197 A | | 8/1989 | Auer et al. | 33/18.1 |
| 4,918,817 A | | 4/1990 | Eaton | 33/1 M |
| 5,063,334 A | | 11/1991 | Tanita et al. | 318/568.1 |
| 5,072,410 A | | 12/1991 | Vachris et al. | 395/103 |
| 5,232,103 A | | 8/1993 | Koenig | 211/69.5 |
| 5,589,859 A | | 12/1996 | Schantz | 347/19 |
| 5,649,828 A | * | 7/1997 | Kawashima | 33/1 M |
| 5,829,151 A | * | 11/1998 | Collier et al. | 33/1 M |
| 6,116,707 A | | 9/2000 | Avida | 346/139 R |

FOREIGN PATENT DOCUMENTS

| | | |
|---|---|---|
| EP | 0 074 190 A2 | 3/1983 |
| JP | 07107220 A | 4/1995 |

* cited by examiner

*Primary Examiner*—John Barlow
*Assistant Examiner*—An H. Do

(57) ABSTRACT

The Pendulum Whiteboard Printer is an effector platform for a fully-automatic robotic device for marking or otherwise effecting whiteboards, pinboards, or other vertical surfaces The effector platform is designed to be suspended by two suspension wires whose lengths are adjusted by motorized spindles mounted above and on either side of the board surface. The position of the effector platform is adjusted by winding and unwinding the wires. Electrical power is supplied to the effector platform through the suspension wires or from an on-board battery. Control of a pen and/or other apparatus on the effector platform is achieved through modulation of the power voltage. The effector platform may be fitted with a variety of end effectors such as dry-erase markers, gripping elements, and squeegees.

6 Claims, 7 Drawing Sheets

EFFECTOR PLATFORM FOR PERFORMING ACTIONS OVER VERTICAL SURFACES

FIELD OF THE INVENTION

The present invention relates generally to performing mechanical actions such as printing, and more particularly to a platform for carrying end effectors for performing the mechanical actions on whiteboards and other substantially vertical surfaces.

BACKGROUND OF THE INVENTION

A great deal of work has been devoted to integrating large drawing and display surfaces with electronic document faculties. Technology has been developed to support two directions of information flow, image capture, and image display.

Image capture technologies enable marks drawn on a surface to be captured in electronic form. These include the pressure-sensitive tablets such as the SMART Board from SMART Technologies, Inc. of Calgary, Alberta, Canada, location-sensitive surfaces accompanied by special pens such as the Liveboard from Xerox Corporation of Stamford, Conn., and Mimeo from Virtual Ink Corporation of Boston, Mass., Laser-based pen trackers such as the SoftBoard from Microfield Graphics, Inc. of Portland, Oreg., camera-based scanning such as the ZombieBoard from Xerox Corporation, and 1-dimensional scan bars such as the Copyboard from Xerox Corporation. The ZombieBoard is further described in U.S. Pat. No. 5,528,290 to Saund, entitled DEVICE FOR TRANSCRIBING IMAGES ON A BOARD USING A CAMERA BASED BOARD SCANNER.

Image display technologies permit stored electronic images to be displayed on a large surface. These include plasma, active matrix, liquid crystal, light-emitting diode, and projectors which can be either front-projection or rear-projection. Of the various image display technologies, only the projectors are compatible with an inexpensive, passive, surface of variable and extensible size. All of the others require dedicated display hardware which is expensive and fixed in size.

In addition to the applications for generating images on large vertical surfaces, a variety of other applications exist such as window washing, moving physical tokens, and the like.

SUMMARY OF THE INVENTION

The present invention is a platform, called an effector platform, for carrying and/or manipulating end effectors to perform various mechanical tasks. The effector platform of the present invention is part of a Pendulum Whiteboard Printer System which is so named because the effector platform of the present invention is suspended against the force of gravity by suspension wires. It is not a true pendulum in the x-y plane because two wires are used.

The present invention provides an inexpensive mechanism for remotely generating images on whiteboards and other substantially vertical surfaces. The term "image" as used in this specification refers to any marking created by a marking element such as a dry-erase pen. The markings may be in the form of textual characters, straight or curved strokes, or any other types of marks that could be hand-drawn.

The effector platform is provided for holding an end effector such as the marking element. The effector platform is suspended by two wires from two spools placed near the upper, outer, boundaries of the surface to be marked on. The lengths of the two wires are adjusted to control the location of the effector platform over the surface to be marked on. These wires are typically wound on motorized spools permitting their lengths to be varied under computer control. The spools may be located above and beyond the ends of the target surface so that all parts of the surface are reachable. If needed, control signals to the effector platform can be provided through the wires using techniques well-known in the art. Power may be supplied to the effector platform through the wires or from an on-board battery.

DETAILED DESCRIPTION OF THE INVENTION

Figure 1:
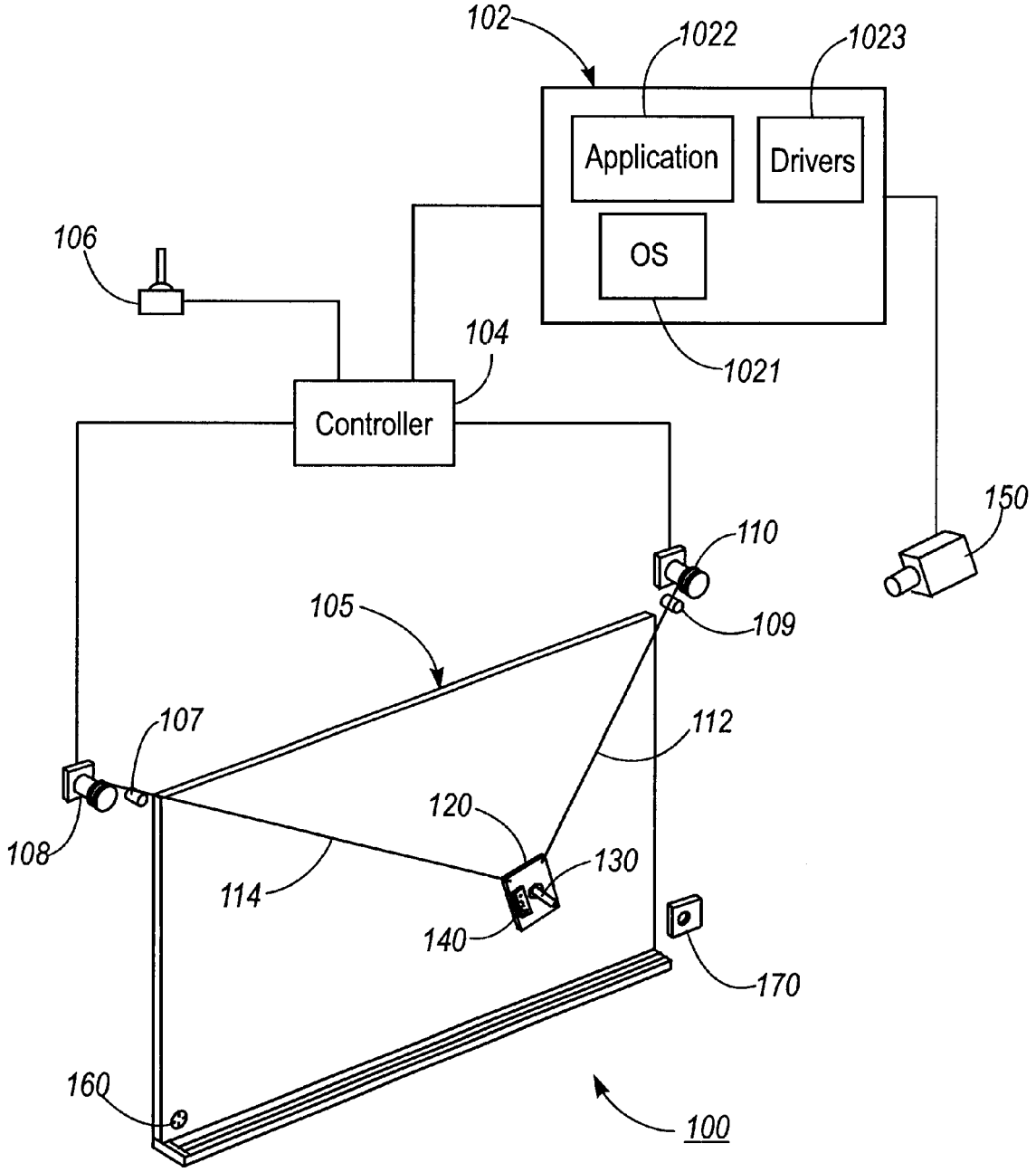
FIG. 1 is a block/perspective view diagram of a Pendulum Whiteboard Printer system according to the present invention.

FIG. 1 depicts the Pendulum Whiteboard Printer system of which the present invention is a part. An end effector 130 such as marking pen or the like is used for creating images on a whiteboard 105. Those skilled in the art will readily appreciate that a dry-erase marker will typically be used for whiteboards. Those skilled in the art will further appreciate that the present invention is not limited to marking on whiteboards, but may be used with any substantially-vertical surface, and that the action performed by the whiteboard printer is not limited to simply making marks, but may also be used for performing other actions, as is discussed in greater detail in concurrently filed, co-assigned, U.S. patent application Ser. No. 09/450, 467 entitled METHOD FOR EFFECTING ACTIONS OVER VERTICAL SURFACES, which is hereby incorporated by reference into the present specification. For ease of discussion, the vertical surface will be referred to herein as a whiteboard. The end effector, 130 is held in place and moved with the effector platform 120 of the present invention. The effector platform 120 is suspended from a left wire 114 and a right wire 112. The left wire 114 is connected to a left spool 108, and the right wire 112 is connected to a right spool 110. The left and right spools are equipped with motors (not shown) of types well-known in the art which control the reeling in and unreeling of wire from the spool. The motors may be stepper motors, or DC motors with shaft sensors or position sensors, or any other such mechanism capable of turning the spools in a controlled manner to reel in and unreel wire. Those skilled in the art will recognize that for such reasons as better control, faster acceleration, more accurate fast positioning, greater tension to control jiggle and bounce, greater tension to produce z-force, control while moving, among others, more than two wires may be used without departing from the spirit and scope of the present invention.

When the whiteboard printer 100 is not in use, the effector platform can be returned to a parking facility 170 to keep pens from drying out, among other reasons. The parking facility 170 is discussed in greater detail in concurrently filed, co-assigned, U.S. patent application Ser. No. 09/450, 466 entitled A PARKING MECHANISM FOR STORING AND EXCHANGING END EFFECTORS IN A SYSTEM FOR PERFORMING ACTIONS, which is hereby incorporated by reference into the present specification.

The whiteboard printer 100 will typically be controlled by a computer 102, through a controller 104, which may be implemented in hardware or software, and may be a separate unit or part of the computer 102. The computer 102 may be any general-purpose computer known in the art. The computer 102 communicates with the whiteboard printer 100 through the controller 104 by way of an interface 103, which may be any commonly-used computer communication interface such as a parallel or a serial interface. If closed-loop positioning is utilized, a camera 150 may be used to provide feedback information to the computer 102, as depicted, or directly to the controller 104. The calculations described below for positioning the effector platform 120 may be performed by the computer 102 and/or the controller 104 and may be implemented in software and/or hardware. Driver programs 1023 for application programs 1022 for such applications as word processing, spreadsheets, and presentation graphics, among others, may be provided to generate their respective outputs on large vertical surfaces. If desired, the positioning of the effector platform 120 may also be manually controlled using a joystick 106 connected to the controller 104, as shown, or to the computer 102. Signals from the computer 102 or joystick 106 are translated by the controller 104 and transmitted to the effector platform 120, where they are decoded by the onboard control electronics 140.

Since the effector platform 120 is suspended from the two wires 114 and 112, the effector platform 120 may be moved to any position beneath and between the left spool 108 and right spool 110 by adjusting the lengths of the left and right wires 114 and 112, respectively. In order to be able to mark on any part of the whiteboard 105, the left and right spools 108 and 110, respectively, are preferably placed above the top edge of the whiteboard and beyond the left and right edges of the whiteboard, respectively, as shown in FIG. 1. The positioning of the effector platform 120 is described in greater detail, along with other aspects of the Pendulum Whiteboard Printer of which the effector platform is a part, in concurrently filed, co-assigned, U.S. patent application Serial No. 09/450, 468 entitled SYSTEM FOR EFFECTING ACTIONS OVER VERTICAL SURFACES, which is hereby incorporated by reference into the present specification.

Figure 2:
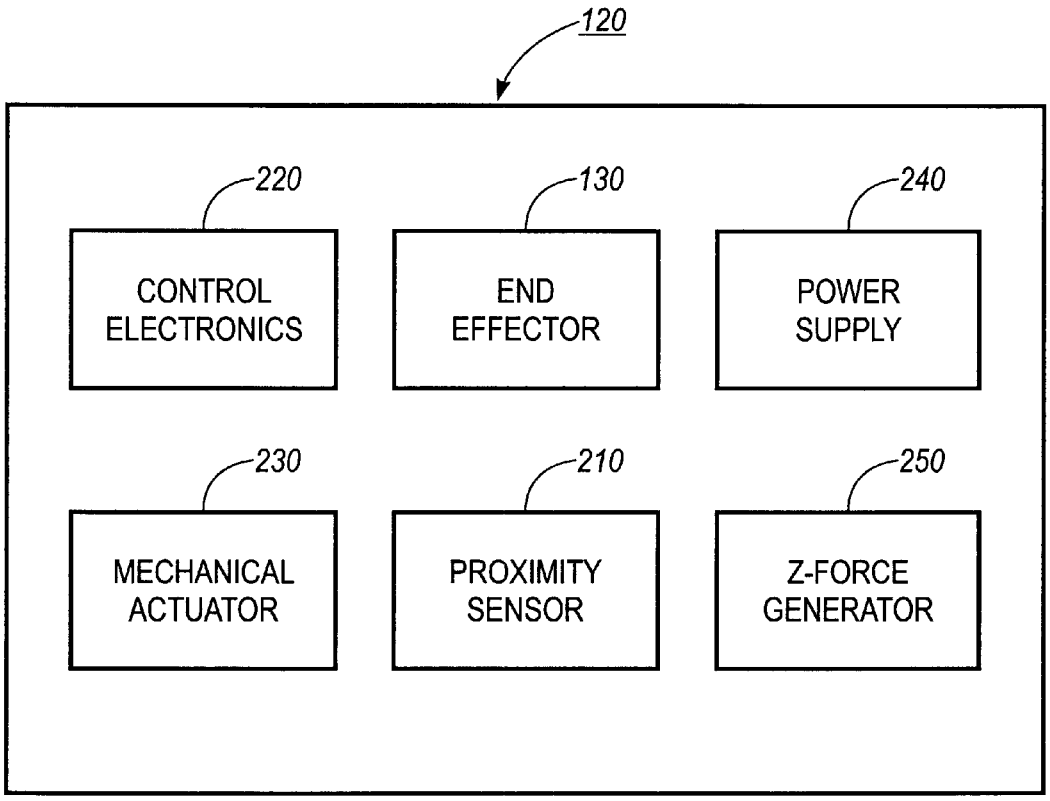
FIG. 2 is a block diagram depicting the functional elements of an effector platform according to the present invention.
Figure 3:
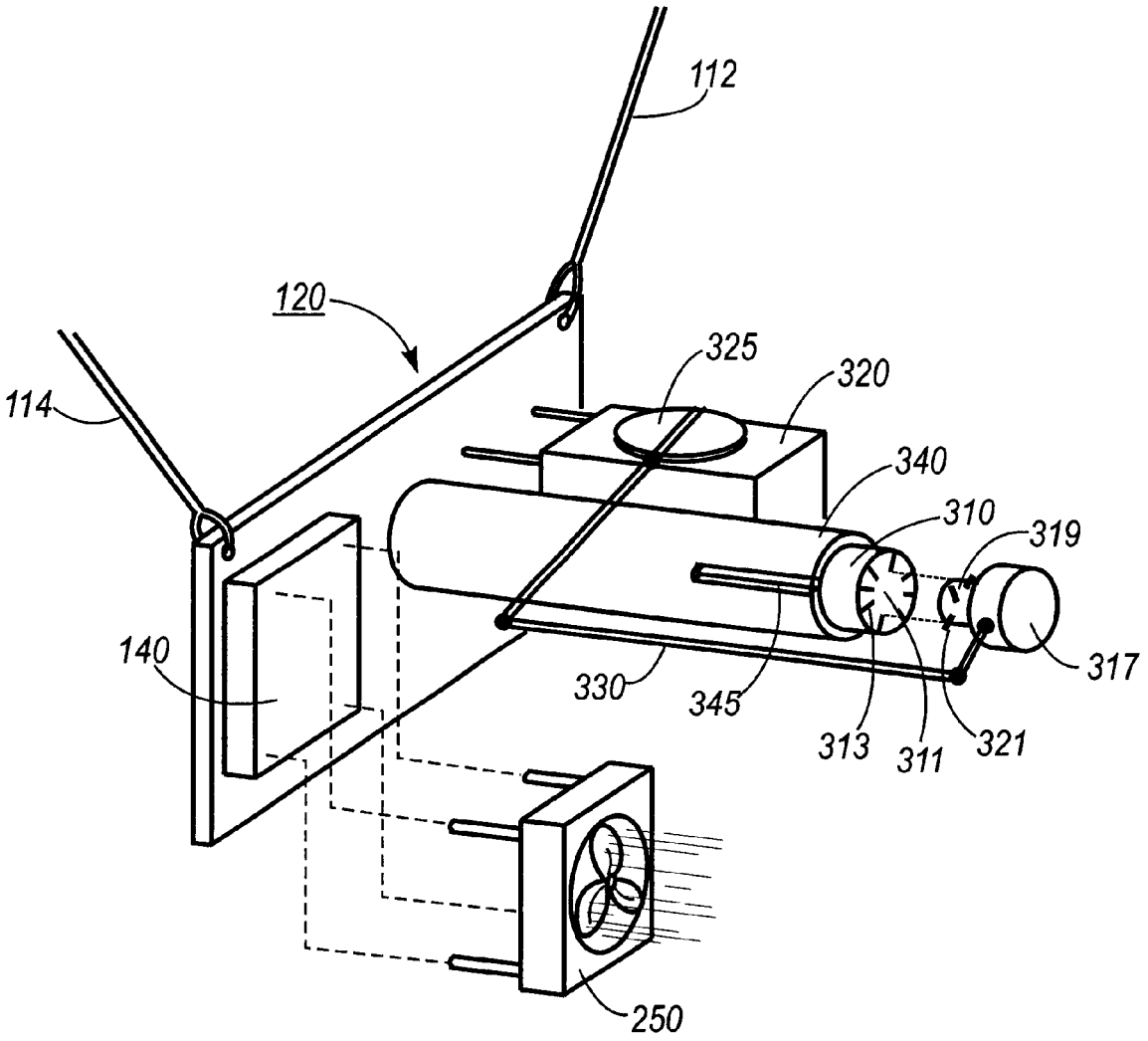
FIG. 3 is a perspective view diagram of an effector platform according to the present invention.

Referring to FIGS. 2 and 3, the effector platform 120 of the present invention includes an end effector 130, a proximity sensor 210, control electronics 220, a mechanical actuator 230, a power supply 240, and a z-force generator 250.

The end effector 130 is the element of the effector platform 120 that does the actual work. In a whiteboard printing environment, for example, the end effector would be a dry-erase marker. Other examples of end effectors will be discussed in greater detail below.

The proximity sensor 210 provides information on how close an end effector is to a surface. It can be practiced using any such proximity sensing mechanisms and techniques as are known and understood in the art. Examples include physical touch sensors as well as echo sensors which bounce light or sound from the surface an determine a return trip time for the echo.

The actuator 230 is operated to manipulate the end effector 130, typically by moving the end effector toward and away from the whiteboard 105 or other substantially vertical surface.

The on-board control electronics 140 are provided to receive control signals from a computer or other external source and convert them into mechanical actions by the end effector 130. These mechanical actions may be for performing any of a wide variety of tasks, as will be appreciated by those skilled in the art.

The power supply 240 supplies power to the control electronics 140, the actuator 230, and if necessary, to the end effector 130 itself. Typically the power supply 240 will be implemented as the left and right suspension wires, 114 and 112, although the power supply 240 may also be a battery of any kind known in the art. Using a battery can be advantageous in not requiring power to be transmitted down the suspension wires, which will allow different materials to be used as the wire as well as reduce the signal noise on the those wires, assuming signals are also transmitted down the suspension wires.

The z-force generator 250 generates a force to push the effector platform 120 either toward or away from the whiteboard 105 or other substantially vertical surface. For some uses of the Pendulum Whiteboard Printer 100, the effector platform 120 may hang purely passively from the suspension wires while the end effector 130 operates on the surface or objects on it. For other uses, the platform must be actively driven closer to the surface. For example, for uses where three-dimensional objects are mounted on a substantially vertical surface, the platform must hang at substantial distance from the board in order to clear these objects while navigating around the board. When the target location is reached, some active means must then be used to move the platform close enough to the surface for the effectors to operate. The z-force generator 250 is used to meet those needs and may be implemented as a fan or propeller mounted on the platform, as shown in FIG. 3, to either blow the effector platform 120 toward the surface or suck it toward the surface. In other embodiments of the invention, electromagnetic attraction may be used. If the surface is metallic as is a conventional white-board, an electromagnet on the effector platform 120 can attract or hold the effector platform to the surface while the end effector 130 performs the mechanical do action.

Figure 4:
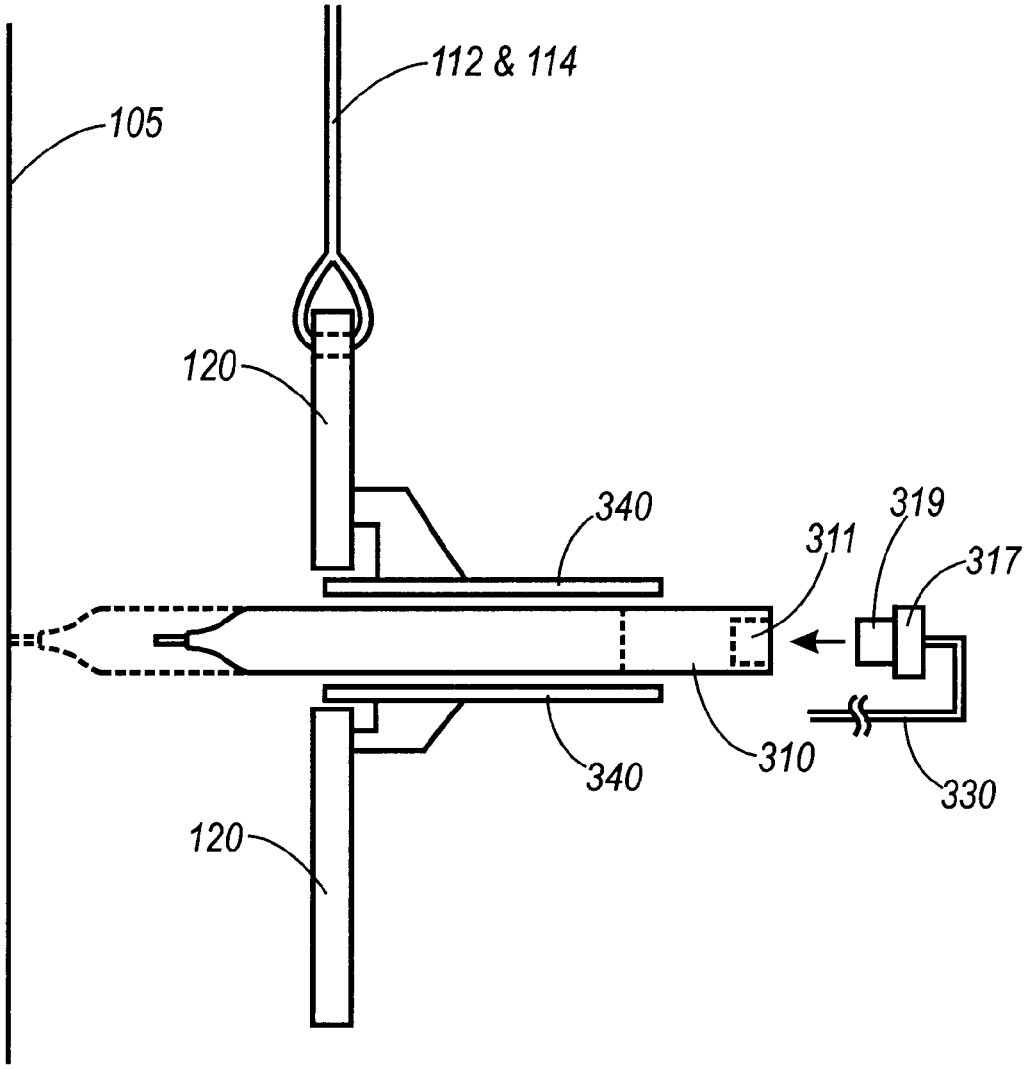
FIG. 4 is a side plan view of an effector platform according to the present invention.

According to a present embodiment of the invention, a marking pen 310, as illustrated in FIGS. 3 and 4, such as a dry-erase marker is used as the primary end effector for creating marks.

The mechanical actuator 230 includes a sleeve 340; a servo motor 320; a mechanical linkage 330; and a mechanism for engaging and disengaging the marking pen 310 . A typical marking pen 310, such as a dry-erase marker, is designed so that the cap (not shown) can be held at the end of the marking pen in a receptacle 311 with engaging ribs 313. The effector cap 317, which is connected to the mechanical linkage 330 is provided with an effector plug 319 configured to securely engage with the receptacle 311. This may be done with an assembly in which the effector plug 319 and effector cap 317 are constructed as a single unit, with the effector plug 319 being slightly smaller than the receptacle 311, but being equipped with engaging arms 321 which may be extended to engage the inside wall of the receptacle 311. Alternatively, the effector plug 319 and effector cap 317 may be implemented as separate units, with the effector plug 319 being made to fit snugly in the receptacle 311 and not be removed except to replace pens which have dried out. Such an effector plug could be constructed from a permanent magnet, and the effector cap 317 could then be implemented with an electromagnet. The actuator could engage and disengage with the marking pen 311 simply by turning the electromagnet on and off, or by reversing the polarity of the electromagnet.

The sleeve 340 of the mechanical actuator is for supporting the marking pen 310. It can be a cylindrical tube, as shown, or may be a partial cylindrical tube or any other physical configuration that provides suitable support. It may be provided with a groove 345 to allow for greater protraction of the marking pen. The servo motor 320 is configured to rotate a disk 325 connected to one end of a mechanical linkage 330, the other end of which is connected to the marking pen 310. The mechanical linkage 330 is configured and coupled to the servo motor 320 and the marking pen 310 in such a way that when the servo motor 320 rotates the disk 325, the mechanical linkage 330 pushes the marking pen 310 into the sleeve 340 or pulls it out from the sleeve, depending on the direction of rotation. The motor 320 may be equipped with a resistance sensor to determine when the end effector has come into contact with the surface.

FIG. 4 depicts the pen 310 in a position retracted away from the surface 105 to enable the effector platform 120 to be moved to a desired location. The pen 310 is then protracted, as depicted by the dashed outline, to touch the surface 105 at the desired target location(s) in order to create marks.

Figure 6:
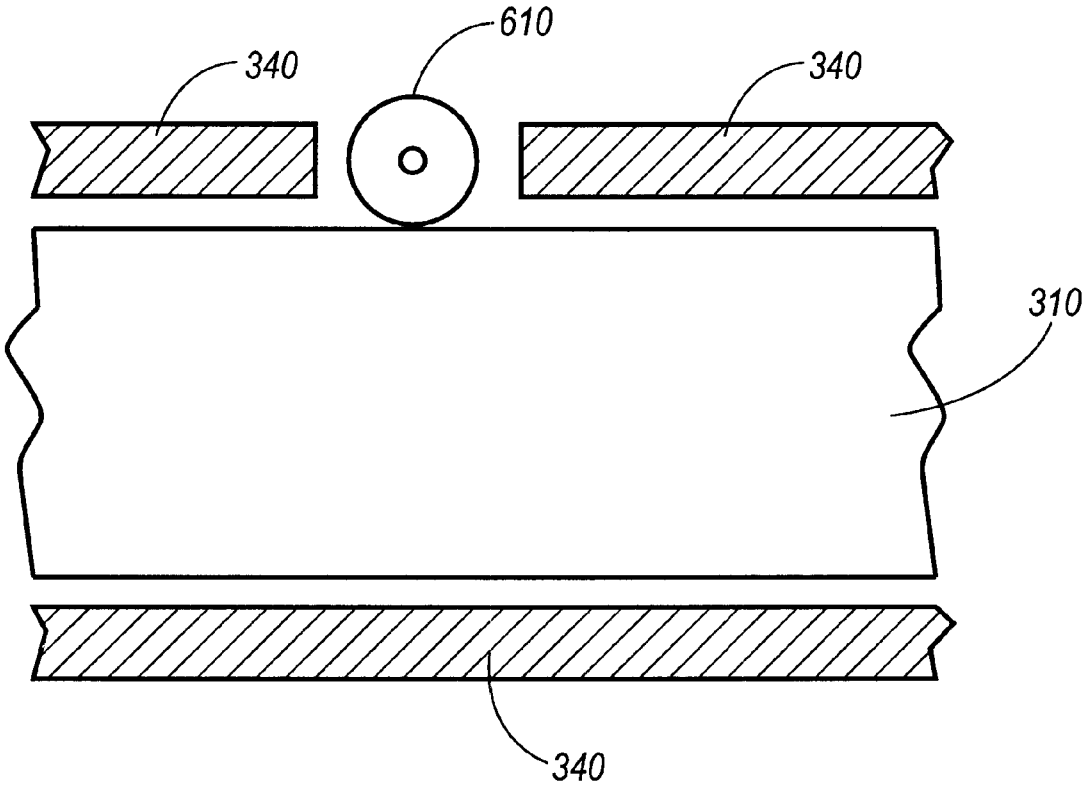
FIG. 6 is a detail view diagram of a part of the effector platform according to the present invention.

FIG. 6 depicts an alternative actuator 230 arrangement where, instead of a servo motor 320 indirectly moving the pen using a mechanical linkage 330 as in FIG. 3, a motor (not shown) rotates a small wheel 610 which protrudes through the sleeve 340 and contacts the pen 310. As the wheel 610 rotates, the pen slides along the length of the sleeve 340, thereby retracting or protracting the pen.

Figure 5:
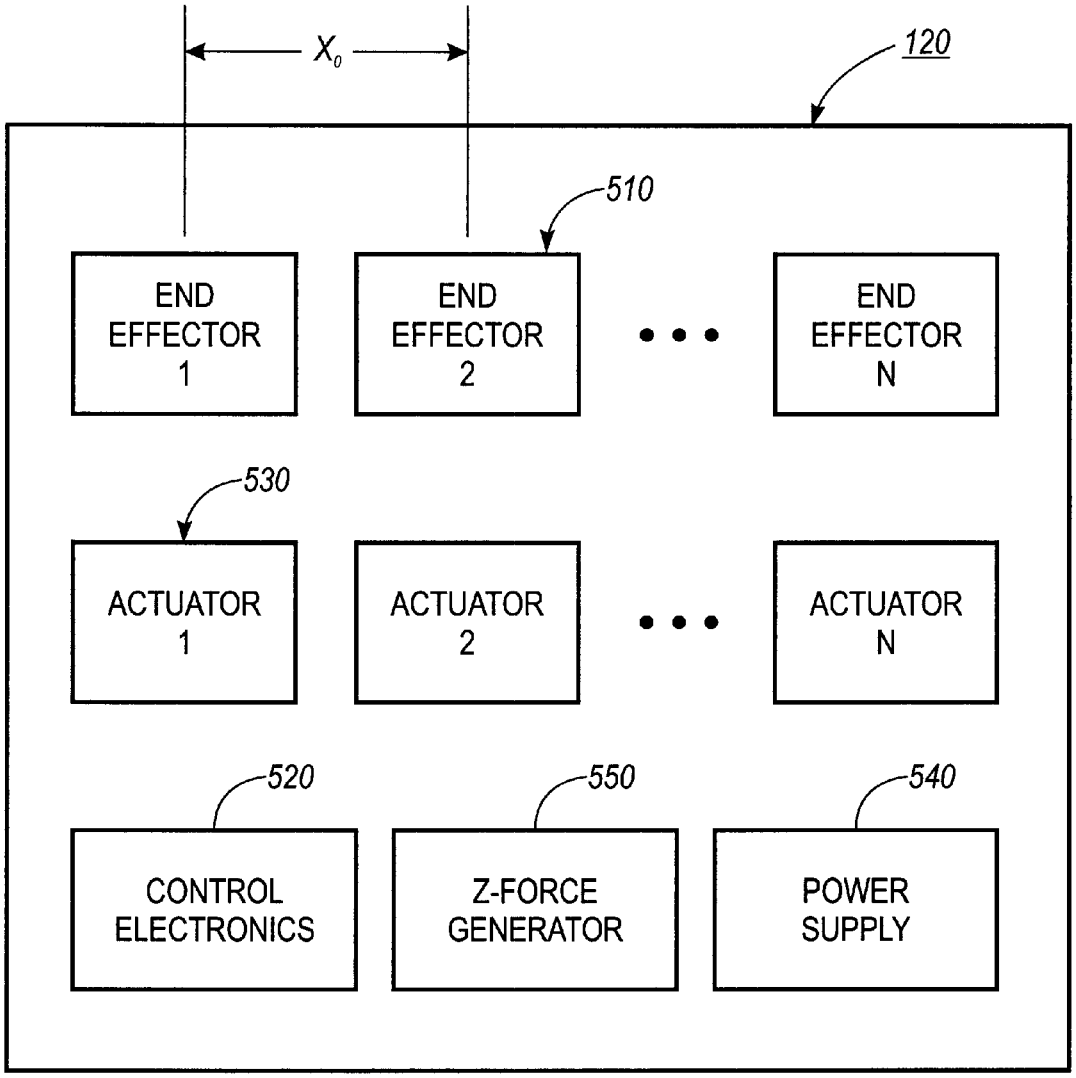
FIG. 5 is a block diagram of a first alternative embodiment of the effector platform according to the present invention.

Referring to FIG. 5 a first alternative embodiment of the present invention is shown in which the effector platform 120 is provided with more than one end effector 510, and a corresponding number of actuators 530. This embodiment is probably most useful in drawing situations where multiple colors are desired. Those skilled in the art will readily appreciate that the relative positions of the different end effectors 510 can be accounted for by simply updating the positioning calculations with an appropriate offset representing the horizontal distance between a desired end effector and some reference point such as a central end effector. The control electronics 520, z-force generator 550, and power supply 540 may all be implemented in a similar manner as with the single end effector embodiment.

Figure 7:
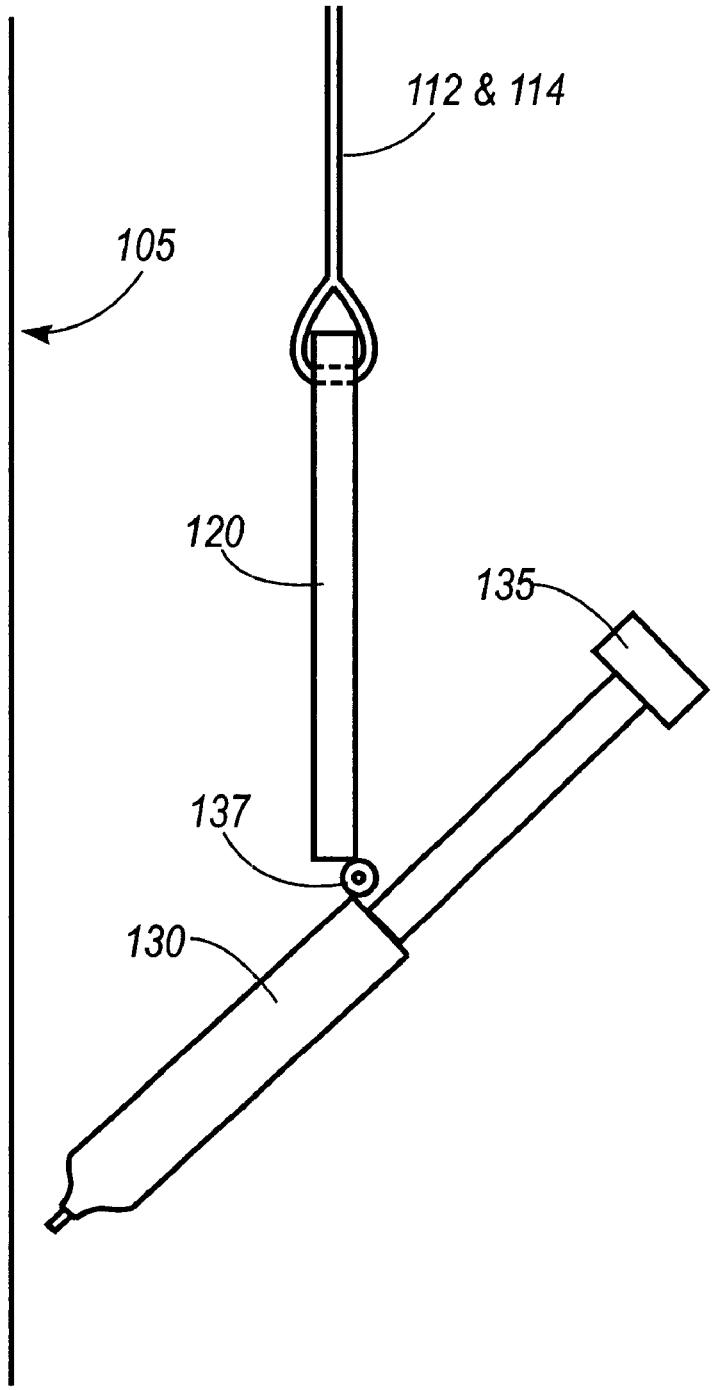
FIG. 7 is a side plan view diagram of a second alternate embodiment of the effector platform according to the present invention.

Referring to FIG. 7 a second alternative embodiment of the present invention is shown in which the effector platform 120 is implemented as a marking pen 130 attached to a pivot point 137, and counterbalanced with a weight 135 that swings the pen toward the board.

Those skilled in the art will readily appreciate that described herein are merely an exemplary configurations for the effector platform, and will recognize that other configurations are possible with the marking pen and for other end effectors, and may be easily implemented to perform various tasks over a vertical surface. Other such end effectors are described in greater detail below.

A variety of means may be used to effect physical and electronic changes to the vertical surface and objects on it. In addition to the retractable pen discussed in the example above, examples of other end effectors include:

- an ink/whiteout/cleaner sprayer where an ink nozzle is directed at the vertical surface to spray one or more colors of ink and/or whiteout from a small reservoir on the effector platform. As an alternative, a marking surface such as a brush, roller, or the like, could be provided on the end effector, and the nozzle and or sprayer could be used to replenish ink, which may include dry-erase ink and other such materials, paint, or other liquid or semi-liquid material on the marking surface. In addition to vector mode drawing where a pen is dragged along the surface by the effector platform, a sprayer could be used for raster mode drawing, where the sprayer could be turned on and off rapidly. Additionally, the spray area could be adjusted by changing the proximity of the sprayer end effector to the surface;
- an eraser implemented as a wand or block with a felt or other soft surface for erasing dry-erase markings on a whiteboard;
- a light pen which could be useful where some objects on the surface may be designed to change state when light shines on them. The effector platform would in this case carry a small light emitter such as a laser pointer;
- a robotic gripper in which a general-purpose or specialized robotic gripper would be able to grab push-pins and the like in order to move or remove items from a pinboard such as a standard bulletin board;
- an electromagnetic transponder which could be useful where some objects on the surface may be designed to respond to radio-frequency signals. The effector platform would in this case bring a transponder within range of individual objects;
- an electrostatic pen for use with an Electric Paper surface, an to both write and erase marks by flipping gyrocron balls. Electric Paper is described in greater detail in co-assigned U.S. Pat. Ser. No. 4,126,854 to Sheridon, entitled TWISTING BALL PANEL DISPLAY;
- a vacuum gripper in which a suction device can grab at objects such as papers. A vacuum gripper may also be used to suck the platform firmly to the board; and
- a quick-change end-effector in which a rack of different end-effectors tools is provided, and a special receptacle on the robotic gripper grabs the appropriate end effector depending on the current task.

As can be seen from the foregoing examples, a wide range of end effectors can be implemented on the effector platform. With any of the possible end effector implementations, the parking facility 170 may be used in various ways beyond merely serving as a stopping place. For instance, the parking facility may be used to swap between various end effectors, or resupply ink, paint, whiteout, cleaning fluid, or other such liquid or semi-liquid material being applied to a substantially vertical surface. Additionally, if power is supplied by a battery, the parking platform could serve as a recharging station. Those skilled in the art will recognize that these implementations can be readily practiced using techniques well-known in the art.

What is claimed is:

1. An effector platform adapted to carry an end effector that performs a marking action at selected locations on a substantially vertical display surface, the effector platform being connectable to first and second effector platform positioners which cooperate to position the effector platform to the selected location, the effector platform comprising:

one or more end effectors;

a platform that receives the one or more end effectors, the platform configured to operate in a substantially vertical orientation, the platform having a carrier for receiving the one or more end effectors in an orientation orthogonal to the platform;

one or more end effector actuators coupled to respective one or more end effectors; and a controller that receives control signals directing the action of the one or more end effector actuators.

2. The effector platform of claim 1, further comprising a z-force generator that generates a force against the effector platform substantially orthogonal to the substantially vertical surface.

3. The effector platform of claim 2, wherein the z-force generator comprises a moving air generator.

4. The effector platform of claim 3, wherein the moving air generator comprises a fan.

5. The effector platform of claim 2, wherein the moving air generator comprises a compressed air jet.

6. The effector platform of claim 2, wherein the z-force generator comprises an electromagnet.

* * * * *